United States Patent [19]

Gotchel et al.

[11] 4,097,965

[45] Jul. 4, 1978

[54] APPARATUS AND METHOD FOR FORMING FIBROUS STRUCTURES COMPRISING PREDOMINANTLY SHORT FIBERS

[75] Inventors: Joel Peter Gotchel, Glen Mills, Pa.; Henry James Norton, Wilmington, Del.

[73] Assignee: Scott Paper Company, Philadelphia, Pa.

[21] Appl. No.: 715,165

[22] Filed: Aug. 17, 1976

[51] Int. Cl.[2] ..... D01G 25/00; D01G 27/00; D01G 13/00

[52] U.S. Cl. ..... 19/306; 264/109; 156/62.4

[58] Field of Search ..... 19/156.3, 156.4, 100, 19/101, 107, 106, 89, 156; 264/109, 165; 156/62.4

[56] References Cited

U.S. PATENT DOCUMENTS

| | | | |
|---|---|---|---|
| 1,462 | 12/1839 | Freeman | 19/105 |
| 949,271 | 1/1910 | Henderson | 19/101 |
| 2,243,685 | 5/1941 | Schiessler | 19/100 |
| 2,244,544 | 6/1941 | Smith | 19/156.4 |
| 2,269,085 | 1/1942 | Morgan | 19/156.4 X |
| 2,936,495 | 5/1960 | Taine et al. | 19/100 |
| 3,051,998 | 9/1962 | Rust Jr. et al. | 19/156 |
| 3,403,425 | 10/1968 | Tajima et al. | 19/156.3 |
| 3,535,187 | 10/1970 | Wood | 156/62.4 X |
| 3,641,628 | 1/1972 | Fehrer | 19/156.4 |
| 3,768,118 | 10/1973 | Ruffo et al. | 19/156.3 |
| 3,787,930 | 1/1974 | Allen | 19/106 R |
| 3,862,472 | 1/1975 | Norton et al. | 19/156.3 X |
| 3,906,588 | 9/1975 | Zafiroglu | 19/156.3 |
| 3,918,126 | 11/1975 | Wood | 19/156.3 |
| 3,949,035 | 4/1976 | Dunning et al. | 19/156.3 |
| 3,972,092 | 8/1976 | Wood | 19/156.3 |
| 4,004,323 | 1/1977 | Gotchel et al. | 19/156.3 |

FOREIGN PATENT DOCUMENTS

| | | | |
|---|---|---|---|
| 12,445 | 2/1907 | United Kingdom | 19/101 |

*Primary Examiner*—Mervin Stein
*Assistant Examiner*—Andrew M. Falik
*Attorney, Agent, or Firm*—Martin L. Faigus; William J. Foley

[57] ABSTRACT

An apparatus for forming a fibrous structure includes a rotatable main drum having projections on its outer periphery for separating fibers from a fibrous feed, and directing the separated fibers through a fiber working section. The working section includes a movable satellite member positioned close to the main drum and having projections on its outer periphery for cooperating with the projections on the main drum to individualize the fibers as they are directed through the working section. A baffle is positioned adjacent the satellite member; between the satellite member and the exit from the working section. The baffle includes a lower air-directing section positioned close to the outer periphery of the main drum and having an air-diverting surface for intercepting air conveyed to it by the outer periphery of the main drum as the main drum is rotated. The air-diverting surface deflects a portion of the intercepted air in a direction generally away from the outer periphery of the main drum into the region between the adjacent satellite member and the baffle to increase the static pressure in that region. The air-diverting surface also deflects a portion of the intercepted air through a constriction provided between the outer periphery of the main drum and a peripheral surface segment of the air-directing section.

The method of this invention relates to the high speed formation of a fibrous structure employing the above-described apparatus.

62 Claims, 4 Drawing Figures

APPARATUS AND METHOD FOR FORMING FIBROUS STRUCTURES COMPRISING PREDOMINANTLY SHORT FIBERS

BACKGROUND OF THE INVENTION

1. Field of the Invention

This invention relates to an apparatus and method for dry-forming fibrous structures, and more specifically, to an apparatus and method for individualizing and blending different length fibers from a laminate feed, and forming a feed mat in which the different length fibers are blended together.

2. Description of the Prior Art

Low basis weight nonwoven fibrous webs in the basis weight range of from about 1 to about 6 oz/yd$^2$ are becoming extremely popular. Some of these webs are formed predominately of short-length cellulosic fibers less than ¼ inch in length, and include a minor proportion, by weight, of longer reinforcing fibers having a length greater than ¼ inch. These webs can be used by themselves, or in conjunction with other materials as substitutes for conventional textile fabrics in articles such as disposable diapers, sanitary napkins, industrial and household wipers, cosmetic pads and the like.

U.S. Pat. No. 3,862,472, issued to Norton et al, and assigned to Scott Paper Company, discloses a highly desirable method for dry-forming a low basis weight nonwoven fibrous web which includes short and long fibers blended together, as described in the preceding paragraph. In accordance with the method disclosed in the Norton et al. patent loosely compacted batts of the short and long fibers are directed into a working section in which the fibers are individualized from their respective batts and blended together to form a fibrous feed mat. The feed mat is directed into a web forming device in which the fibers are again separated into their individual components and redeposited on a forming surface in the form of a fibrous web having a basis weight in the range of from about 1 to about 6 oz/yd$^2$. The fibrous feed mat has a basis weight at least 3 times the average basis weight of the low basis weight nonwoven fibrous web to be formed, and in all cases, has a basis weight greater than 12 oz/yd$^2$.

In the Norton et al process the blending operation, in which the individual batts of long and short fibers are separated into their individual fibers components and blended together, has been a significant speed limiting factor in the formation of low basis weight fibrous webs. Specifically, devices of the general type employing a main drum and satellite worker rolls are usable to accomplish the blending operation at low speeds. However, at high-production speeds these prior art devices do not reliably process fibrous material in which the predominate fiber component, by weight, is less than ¼ inch in length, such as wood pulp fibers and cotton linters. At high production speeds it is preferred to rotate the main drum at a peripheral speed in excess of 10,000 feet/minute.

One prior art device which is capable of a fairly high speed operation is disclosed in U.S. Pat. No. 3,641,628. However, that device is designed to process 100% textile-length fibers, and is not operable, in a reliable manner, to process fiber blends including short fibers under ¼ inch in length. Moreover, the device disclosed in the U.S. Pat. No. 3,641,628 is designed to permit the main drum to be continuously rotated at a surface speed approaching only 9,500 feet/minute; not at a speed in excess of 10,000 feet/minute as is desired in the high speed formation of a fibrous feed mat including a blend of textile-length fibers and shorter-length fibers. When the main drum is rotated at a surface speed in excess of 8,000 feet/minute it acts as a pump to pull excessive quantities of air into the working section of the apparatus. The air which is pulled into the working section is not properly controlled to permit short fibers under ¼ inch in length to be individualized and positively directed through the outlet of the working section for deposition on a forming wire. Specifically, a substantial portion of the air flow about the satellite worker and turner rolls is counter to the direction in which the fibers are moved by said satellite rolls as said fibers are being processed. This counter air flow tends to prematurely doff, or separate the blend of short and long fibers from the toothed peripheries of the satellite rolls. These doffed fibers intermingle with each other and form "ropes" of fibers in the working area. These "ropes" ultimately will jam the apparatus and thereby cause poor quality formation of a fibrous web on the forming wire. Moreover, the formation of "ropes" in the working section requires undesirable machine down time for cleaning out the apparatus. The longer length textile fibers are hooked by the teeth of the satellite rolls much better than the short length fibers under ¼ inch in length. This better hooking of the long fibers prevents the counter air flow over the satellite rolls from prematurely doffing the textile-length fibers from those rolls.

SUMMARY OF THE INVENTION

This invention relates to an apparatus and method for dry-forming fibrous structures at high production speeds, and more specifically, to dry-forming a fibrous mat including predominately short-length fibers less than ¼ inch blended with a minor proportion, by weight, of longer-length textile fibers. In the most preferred embodiment of this invention the apparatus and method are employed to form a high basis weight feed mat which can be directly fed into a web former to form a low basis weight fibrous web in the basis weight range of from about 1 to about 6 oz/yd$^2$. For example, the high basis weight feed mat could be directed into a Rando-Webber to form the low basis weight fibrous web. The Rando-Webber is a web forming device manufactured by Curlator Company of Rochester New York.

The apparatus of this invention includes a rotatable main drum having projections on its outer periphery. The main drum is rotatable past an inlet section at which a fibrous feed is directed into engagement with the periphery of said main drum. The main drum separates fibers from the feed, and directs the separated fibers into a working section in which said fibers are further individualized. A baffle arrangement is provided at the inlet section to restrict the open area through which air can be pumped into the apparatus for conveyance to the working section. In other words, the baffle arrangement minimizes the volume of air that can be pumped into the working section by high speed rotation of the main drum. The individualized fibers are directed out of the working section by the rotation of the main drum to a fiber release zone on the periphery of said drum. The fibers are released from the periphery of the main drum in the release zone, and thereafter are conveyed to a forming surface on which a fibrous structure is formed.

The working section includes a rotatable satellite member positioned close to the main drum and having projections on its outer periphery. The projections on the satellite member cooperate with the projections on the periphery of the main drum for aiding in individualizing fibers directed through the working section by said main drum. A unique baffle is positioned adjacent the satellite member and between said satellite member and the exit from the working section. The baffle includes a lower air-directing section positioned close to the outer periphery of the main drum. The air-directing section includes an air-diverting surface for intercepting air conveyed to it by the outer periphery of the main drum as the main drum is rotated. The air-diverting surface deflects a portion of the intercepted air in a first direction generally away from the outer periphery of the main drum into the region between the adjacent satellite member and the baffle. This increases the static pressure in the region between the satellite member and the baffle. Increasing the static pressure minimizes air-flow counter to the direction of rotation of fiber flow on said satellite member. By minimizing air-flow counter to the direction of fiber flow, the blend of short and long fibers will not be doffed prematurely from the satellite members and "rope" to jam the apparatus.

The air-diverting surface also deflects a portion of the intercepted air in a second direction through a constriction provided between the outer periphery of the main drum and the periphery of the air-directing section. In the preferred embodiment of the invention a satellite member is also positioned beyond the air-directing section, and the air directed through the constriction is controlled to flow between the main drum and the last-mentioned satellite member. Most preferably the baffle extends for the full cross-machine-direction dimension of the apparatus and is joined to the top and side walls of a housing which is positioned about the satellite members. In this manner the baffle substantially isolates the actions of the satellite members positioned on opposite sides thereof.

In the most preferred embodiment of this invention the baffle is positioned between adjacent and identical sets of satellite rolls. Each set of satellite rolls includes a rotatable worker roll and a rotatable turner roll, both of which are adapted to be rotated at a considerably slower speed than the main drum. The worker roll in each set is positioned beyond its respective turner roll. As fibers are processed within the working section they are directed onto the periphery of the worker roll from the main drum, and are transferred to the turner roll for redeposition onto the periphery of said main drum. The most severe working and individualization of the fibers takes place at the junction between the worker roll and main drum, and between the turner roll and main drum. It is at those junctions that a drastic speed change is encountered by the fibers, and that speed change enhances fiber separation.

The housing positioned about the sets of satellite rolls provides a seal between said satellite rolls and the atmosphere, except for the provision of a passageway for permitting air from the surrounding atmosphere to enter the working section downstream of the baffle. The passageway in the housing permits the air to enter the working section between the worker roll that is positioned beyond the baffle and the exit from said working section. The action of the satellite rolls on the side of the baffle opposite the passageway will not be effected by air flow through said passageway since the baffle cooperates with the housing to isolate the satellite rolls on opposite sides thereof. Air which is pumped into the working section through the passageway will move adjacent the worker roll to increase the static pressure in that area. This increase in static pressure minimizes air flow about the worker roll in a direction counter to the direction of fiber flow. This prevents premature doffing of fibers from the satellite rolls, and the roping of such fibers, as explained earlier. Accordingly, by preventing air flow counter to the direction of fiber flow over the set of satellite rolls positioned beyond the baffle, a fiber feed including a predominate amount, by weight, of short fibers under $\frac{1}{4}$ inch in length can be properly processed by said last-mentioned satellite rolls.

In accordance with the preferred embodiment of this invention an outlet orifice accelerates the flow of air and fibers from the working section to the fiber release zone. The outer periphery of the main drum constitutes one wall of the outlet orifice, and a guide plate arrangement spaced from the periphery of the main drum provides the opposed wall of the orifice. The entrance to the orifice is of a greater depth than the exit from said orifice, whereby said orifice acts as a nozzle to accelerate the flow of individualized fibers from the working section into the release zone. This acceleration smooths the cross-machine-direction profile of the flow of fibers into the release zone, and contributes to establishing the desired basis weight profile in the cross-machine-direction of the fibrous structure which is formed from the fiber flow.

In the preferred method of this invention a preponderance, by weight, of short cellulosic fibers of a papermaking length less than $\frac{1}{4}$ inch is blended with a minor proportion of textile-length fibers greater than $\frac{1}{4}$ inch by employing the apparatus of this invention. Most preferably the fibrous structure which is formed is a feed mat which is adapted to be directed into a web former to form a low basis weight fibrous web in the basis weight range of from about 1 to about 6 oz/yd$^2$. In this regard the feed mat which is formed in accordance with the preferred embodiment of this invention has a basis weight of at least 12 oz/yd$^2$, and in all cases is at least 3 times the basis weight of the fibrous web which is to be formed.

Preferably the instant invention is employed in the process for forming a low basis weight nonwoven fibrous web described in the Norton et al patent (U.S. Pat. No. 3,862,472). That patent is incorporated by reference into the instant application. It has been found that the apparatus of this invention can be operated at a considerably higher speed than prior art blending apparatus, and this permits the process described in the Norton et al patent to also be carried out at a higher speed. In fact, the apparatus of this invention has been employed to form a feed mat in the basis weight range of from about 12 to about 50 oz/yd$^2$ at a speed in excess of 60 feet/minute.

Other objects and advantages of this invention will become apparent upon referring to the detailed description which follows, taken in conjunction with the drawings.

DESCRIPTION OF THE PREFERRED EMBODIMENT OF THE INVENTION

This invention relates to an apparatus and method for forming fibrous structures. Most preferably the invention resides in blending papermaking length fibers less than ¼ inch with longer textile-length fibers to form a fibrous feed mat in which the papermaking length fibers, by weight, are the predominate fiber component. Most preferably the fibrous feed mat formed in accordance with this invention is directed into a web forming device for forming a low basis weight fibrous web in the basis weight range of from about 1 to about 6 oz/yd$^2$. The fibrous feed mat formed in accordance with the preferred embodiment of this invention has a basis weight of at least 12 oz/yd$^2$, and is at least 3 times greater than the basis weight of the fibrous web which is formed from it. The apparatus of this invention includes unique features which may be suitable for use in the formation of other web structures. However, in accordance with the preferred embodiment of this invention the apparatus is employed to form a fibrous feed mat of blended long and short fibers, as described above. Therefore, details of the present invention will be described in connection with the formation of such a feed mat.

Figure 1:
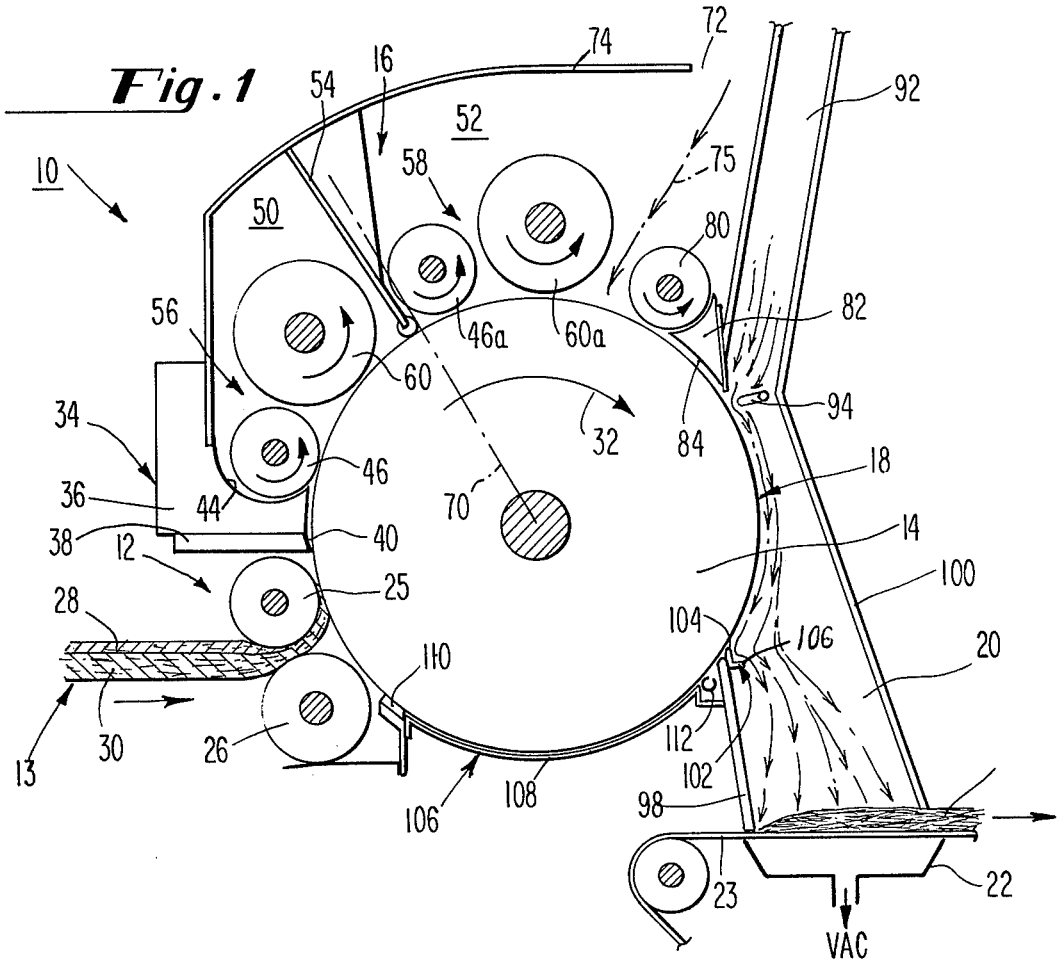
FIG. 1 is a schematic side elevation view of the apparatus of this invention.

Referring to FIG. 1, the apparatus 10 of this invention includes an inlet section 12 for receiving a laminate fibrous feed 13, and directing the feed against the toothed periphery of a main drum 14. The main drum 14 separates fibers from the fibrous feed 13, and conveys the separated fibers through a working section 16. The working section 16 is operative to further separate, or individualize the fibers. When different types of fibers are included in the fibrous feed the working section 16 also blends together the individualized fibers. From the working section 16 the outer periphery of the main drum 14 moves to a fiber release zone 18, at which the outer periphery of the drum moves downwardly in a generally vertical direction. A substantial portion of the blended fibers separate from the main drum in the release zone 18 by the action of centrifugal force. Thereafter, the blended fibers are conveyed through a formation chamber 20, and, with the aid of a pressure differential established through vacuum box 22, are deposited on a foraminous forming surface 23 in the form of a fibrous feed mat 24.

Upper and lower feed rolls 25 and 26, respectively, are provided at the inlet section 12 for engaging the opposed flat surfaces of the fibrous feed 13 to direct said feed into engagement with the periphery of the main drum 14. In accordance with the preferred use of this invention the fibrous feed 13 includes textile-length fibers over ¼ inch in length, and most preferably is a laminate including a loosely compacted upper layer 28 of textile-length fibers greater than ¼ inch, and a loosely compacted lower layer 30 of short cellulosic fibers of a papermaking length less than ¼ inch. Preferably, the upper roll 25 has projections, such as teeth or pins, on its outer periphery for engaging the upper layer 28 of textile-length fibers during the feeding operation. The lower roll 26 can be smooth-surfaced or knurled, as desired. The reason for this construction of the rolls 25 and 26 will be explained in detail later in conjunction with the description of the preferred method of this invention.

In the preferred embodiment of this invention the textile-length fibers which are employed are either rayon or polyester; however, the specific long fiber component is not considered to be a limitation of the present invention. The preferred short fiber component is wood pulp because it is readily available, relatively economical and highly absorbent. Absorbency is particularly important when the fibrous mat, or a low basis weight fibrous web formed from said mat, is intended to be used for applications requiring the retention of liquids. Other short fibers, such as cotton linters, can also be employed in this invention; the particular short fiber component not being considered a limitation on the broader aspects of the invention.

Figure 2:
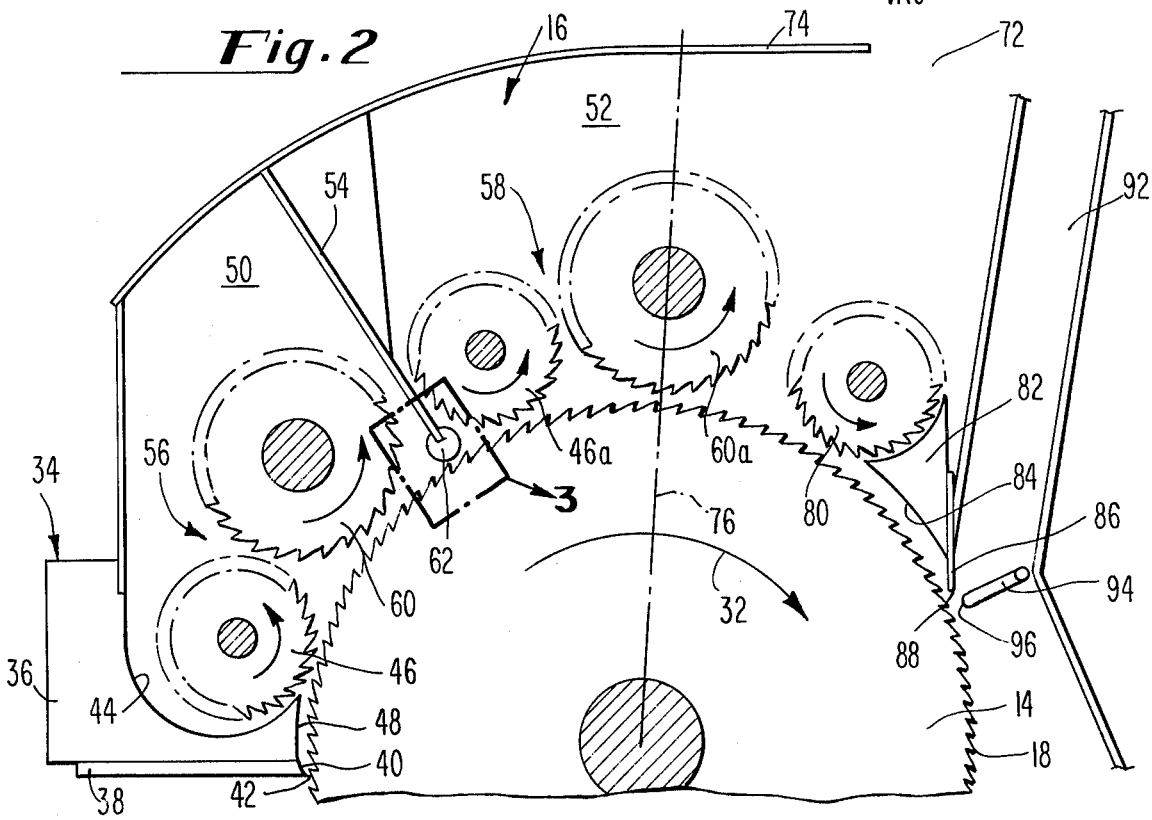
FIG. 2 is an enlarged side elevation view of a portion of the apparatus shown in FIG. 1, showing further details of construction.

The main drum 14 includes projections in the form of teeth on its outer periphery. The main drum is rotated in a clockwise direction, as indicated by arrow 32, preferably at a surface speed greater than 10,000 feet/minute. Most preferably the main drum 14 is rotated at a surface speed of about 13,000 feet/minute. In a preferred construction of the invention the main drum is 24 inches in diameter, and is rotated at 2,100 rpm. This corresponds to a peripheral surface speed of about 13,200 feet/minute. The teeth on the outer periphery of the main drum 14 have a positive rake (FIG. 2). That is, the teeth are inclined in the direction of rotation of the main drum so that they are oriented to hook the fibers of the laminate feed 13 as the main drum is advanced past the feed rolls 25 and 26.

Referring to FIGS. 1 and 2, a feed roll baffle arrangement 34 is provided to prevent an excessive quantity of air from being pumped through the inlet section 12 by the high speed rotation of the main drum 14. The baffle arrangement 34 includes an upper section 36 and a lower section 38. Most preferably the lower section 38 is movably mounted on the upper section so that it can be adjusted relative to the outer periphery of the main drum 14. Most preferably the lower section 38 includes an inclined, or tapered front surface 40 which diverges from the periphery of the main drum in an upward direction, as illustrated in FIGS. 1 and 2. In view of the tapered construction of the front surface 40 the lower edge 42 thereof is closest to the periphery of the main drum 14. Preferably the lower edge 42 is positioned considerably less than 0.100 inches from the periphery of the main drum 14, and most preferably is positioned at about 0.004 inches from said periphery. This close spacing between edge 42 and the outer periphery of the main drum 14 acts as a seal to minimize the amount of air which is pumped through the inlet section 12 into the working section 16 by the high speed rotation of said main drum.

The upper section 36 of the baffle arrangement 34 includes a concavely curved top surface 44 which circumscribes a turner roll 46 located in the working section 16 of the apparatus. A front surface 48 of the upper section 36 in positioned close to the main drum 14, and cooperates with the periphery of the main drum for directing the flow of air and fibers along said main drum for passage under the turner roll 46. In the most preferred embodiment of the invention the front surface 48 is spaced about 0.100 inches from the outer periphery of the main drum 14.

Referring to FIGS. 1 and 2, the working section 16, into which fibers are directed by the main drum 14, includes fiber working areas 50 and 52 separated by a unique baffle plate 54. The construction of the baffle plate will be described later in this application.

Referring to FIG. 2, the working areas 50 and 52 include sets of satellite rolls 56 and 58, respectively. The sets of satellite rolls 56 and 58 are identical in construction, and cooperate with the main drum 14 for individualizing fibers as said fibers are directed through the working section 16. The set of satellite rolls 56, which is the first set encountered by fibers directed into the working section 16, includes a worker roll 60 and the earlier-referred-to turner roll 46. The worker roll 60 and turner roll 46 are positioned close to each other, and close to the periphery of the main drum 14 for cooperating with each other and with the main drum to individualize fibers which are directed through the working section 16. The turner roll 46 is closer to the main drum 14 than it is to the worker roll 60. The worker roll 60 is closer to the turner roll than it is to the main drum. This positional arrangement sets up a static pressure profile in the working area 50 which encourages air to flow adjacent the periphery of the main drum. In a preferred embodiment of the invention the peripheries of the turner roll 46 and the main drum 14 are spaced 0.015 inches apart, the peripheries of the turner roll 46 and the worker roll 60 are spaced 0.020 inches apart and the peripheries of the worker roll 60 and main drum 14 are spaced 0.025 inches apart. The worker roll 60 and the turner roll 46 are rotated at substantially the same surface speed, and that surface speed is considerably slower than the surface speed of the main drum 14. For example, the worker and turner rolls are rotated at a surface speed in the range of from about 200 to 300 feet/minute, as compared to a main drum surface speed which preferably is over 10,000 feet/minute.

Referring to FIG. 2, the worker roll 60 is rotated in a counterclockwise direction, and the teeth on the periphery thereof have a negative rake. That is, the teeth are inclined opposite to the direction of rotation of the worker roll 60. The main drum 14, which is rotated considerably faster than the worker roll 60, moves fibers past the slower moving teeth of the worker roll. Fibers which are not completely individualized as they are separated from the laminate feed 13 (i.e., clumps of fibers) will extend above the periphery of the teeth of the main drum 14, and will be directed into hooked engagement with the negative rake teeth of the worker roll 60. In view of the fact that the worker roll 60 is rotated at a considerably slower speed than that of the main drum 14, the velocity of the fibers is retarded as said fibers are transferred from the main drum the the worker roll. This retardation aids in combing fibers to individualize them.

The turner roll 46 is rotated in a counterclockwise direction, and the teeth on the periphery thereof have a positive rake. The relationship between the tooth rake and the direction of rotation of the turner roll 46 and the worker roll 60, respectively, causes fibers to be transferred to the turner roll from the worker roll as the peripheries of said rolls move past each other. The positive rake of the teeth on the turner roll 46 precludes the turner roll from lifting fibers off of the main drum 14, and in fact, functions to redeposit fibers on the main drum which have been transferred to it from the worker roll 60. Unseparated groups of fibers which are returned to the main drum 14 by the turner roll 46 can again be worked by the coaction of the main drum 14 and the worker roll 60. Clumps of fibers which escape the action of the first set of satellite rolls 56 will be moved by the main drum 14 into the second working area 52. In the second working area the fibers can again be subjected to further separation, or individualization, by the cooperation of the main drum 14 with the worker roll **60*a* and the turner roll 46*a* of the second set of satellite rolls 58**.

Figure 3:
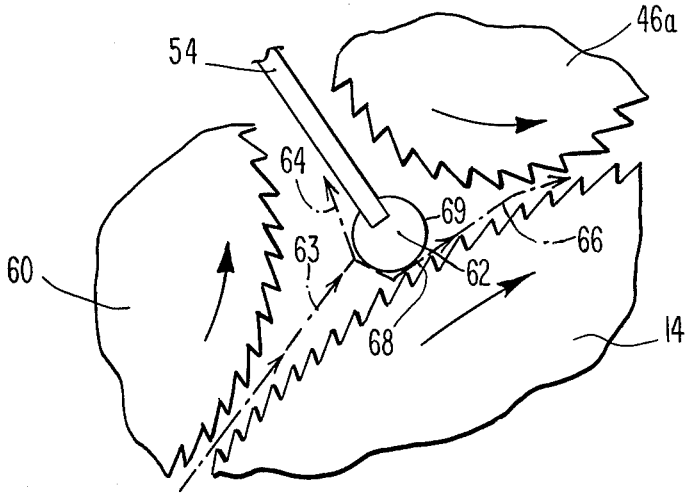
FIG. 3 is an enlarged view of the blocked portion of FIG. 2, identified by the numeral 3.

Referring to FIG. 3, the unique baffle plate 54 of this invention includes a lower air-directing section 62. Preferably the air-directing section 62 is substantially cylindrical, and extends for the entire cross-machine-direction of the apparatus 10. The spacing between the periphery of the main drum 14 and the periphery of air-directing section 62 preferably is no greater than 0.2 inches. Most preferably the spacing is as small as possible without causing interference between the peripheries of the main drum and the air-directing section. Air is moved toward the air-directing section by the high speed rotation of the main drum 14, as indicated by arrow 63. This air movement is intercepted by an upstream curved segment of the air-directing section for splitting the air into separate components indicated by arrows 64 and 66, respectively. The volume of air in the component indicated by arrow 64 is considerably less than the volume in the component indicated by arrow 66.

The component of air indicated by arrow 64 is diverted away from the periphery of the main drum 14 into the region between the periphery of the worker roll 60 and the baffle 54. The component of air indicated by arrow 66 is directed through a constricted area 68 provided between the lower end of the air-directing section 62 and the outer periphery of the main drum 14. The constricted area 68 confines the flow of air to the periphery of the main drum 14 so that it will be conveyed between said main drum and the turner roll **46*a* of the second set of satellite rolls 58**.

Diverting a portion of the air in the general direction of arrow 64 increases the static pressure adjacent the downstream end of the worker roll 60. This increase in static pressure reduces the pressure drop from the upstream end of the turner roll 46 to the downstream end of the worker roll. By reducing this pressure drop the air flow will not tend to flow around the turner roll 46 and the worker roll 60 in a direction counter to the direction of rotation of fiber flow on said worker and turner rolls. In fact, the air will tend to stay on the outer periphery of the main drum 14, and be conveyed by the main drum past the turner roll 46 and the worker roll 60 of the first set of satellite rolls 56. It should be appreciated that the earlier-described feed roll baffle arrangement 34, and the static pressure profile set up by the spacing among the turner roll 46, the worker roll 60 and the main drum 14, contribute to confining the air flow to the periphery of the main drum 14. This prevents air flow around the turner roll 46 and the worker roll 60 in a direction counter to the direction of rotation of fiber flow on said worker and turner rolls. By avoiding air flow counter to the direction of fiber flow, as described above, the blend of long and short fibers will not be doffed prematurely from the turner roll 46 and the worker roll 60, and will be properly processed through the first fiber working area 50. If the blend of fibers were doffed prematurely from the worker and turner rolls, they would group together and form "ropes" of fibers in the working area 50. Such "ropes" would jam the apparatus, and thereby cause poor quality formation of the fibrous mat 24, as well as requiring undesirable machine down time so that the apparatus could be cleaned out.

As explained above, a component of air is also diverted in the direction indicated by arrow 66 through the constricted area 68. After passing the constricted area 68 the air is directed under the turner roll 46*a* of the second set of satellite rolls 58. By controlling the flow of air in this manner the air is prevented from being intercepted by the turner roll 46*a*, and deflected in a direction opposed to the direction of rotation of said turner roll. In this latter regard, the air-directing section 62 controls the flow of air past the turner roll 46*a* in a manner similar to that in which the feed roll baffle arrangement 34 controls the flow of air past the turner roll 46. In order to insure that the component of air indicated by arrow 66 is directed between the periphery of the turner roll 46*a* and the periphery of the main drum 14, the downstream edge 69 of the air-directing section 62 preferably should underlie the turner roll 46*a*. Reference in this application to the downstream edge of the air-directing section underlying the turner roll means that a line drawn from the axis of rotation of the main drum 14 tangent to the downstream edge of the air-directing section 62 will intercept the periphery of the turner roll 46*a*, as indicated in phantom at 70 in FIG. 1. The air-directing section 62 need not be cylindical in configuration. However, in the most preferred embodiment of this invention the upstream curved segment of the air-directing section has a convex curvature for splitting the air flow intercepted by it.

Preferably the turner roll 46*a* is closer to the main drum 14 than it is to the worker roll 60*a*, and the worker roll 60*a* is closer to the turner roll 46*a* than it is to the main drum. This positional arrangement sets up a static pressure profile in the working area 52 which encourages the flow of air adjacent the periphery of the main drum. In a preferred embodiment of the invention the peripheries of the turner roll 46*a* and the main drum 14 are spaced 0.030 inches apart, the peripheries of the turner roll 46*a* and the worker roll 60*a* are spaced 0.035 inches apart and the peripheries of the worker roll 60*a* and main drum 14 are spaced 0.040 inches apart.

In order to prevent an undesirably large pressure drop from the upstream end of the turner roll 46*a* to the downstream end of the worker rolls 60*a* a passageway 72 is provided in the top wall 74 of a housing positioned about the working section 16. This passageway permits air from the surrounding atmosphere to enter the working section downstream of the baffle 54. The passageway 72 is included in a region of the housing between the worker roll 60*a* and the exit end of the working section 16, and a flow of atmospheric air, indicated by arrow 75, is drawn through the passageway adjacent the downstream end of the worker roll 60*a* by the pumping action created by the high speed rotation of the main drum 14. Most preferably the passageway 72 extends for the entire cross-machine-direction of the apparatus 10, and is provided in the top wall 74 of the housing downstream of the intersection, with the top wall 74, of a plane which passes through the axes of rotation of the main drum 14 and the worker roll 60*a*. This plane is indicated by the phantom line 76 in FIG. 2. By permitting atmospheric air to communicate with the working area 52 adjacent the worker roll 60*a* the static pressure at that location is increased. This prevents air flow over the turner roll 46*a* and the worker roll 60*a* in a direction opposed to the direction of fiber movement on said turner and worker rolls. Such counter air flow would cause the fibers to be prematurely doffed from the worker-turner rolls and accumulate in the working section 52. As these fibers accumulate in the working section they intermingle and form undesirable "ropes" in the manner described earlier in connection with working section 50.

The housing about the working section 16 seals the working section from the atmosphere, except in the region of passageway 72. Moreover, the baffle 54 extends for the entire cross-machine-direction and is sealed to top and side walls of the housing between the working areas 50 and 52. Since the baffle 54 is sealed to the housing it separates the action of the satellite rolls in the working area 50 from the action of the satellite rolls in the working are 52. Moreover, the seal provided about the working section 16 by the housing aids in preventing uncontrolled air flow into said working section.

Referring to FIGS. 1 and 2, a seal roll 80, which is similar in construction to the turner rolls 46 and 46*a*, is positioned downstream of worker roll 60*a* to confine the air flow on the periphery of the main drum 14 for passage to the release zone 18. The teeth of the seal roll are provided with a positive rake, and the periphery of the seal roll is rotated at a considerably slower speed than the periphery of the main drum 14. The arrangement of the teeth on the main drum 14 relative to the teeth on the seal roll 80 prevents the seal roll from picking fibers off the periphery of the main drum as said main drum conveys the fibers past the periphery of said seal roll. It is understood that the seal roll 80 is one means of confining the air flow on the periphery of the main drum 14; however, other seal means, such as a stationary plate, also could be utilized.

It is highly desirable to provide a smooth, uniform, cross-machine-direction profile of the air-fiber stream as it is directed out of the working section 16 into the release zone 18. Such a uniform profile contributes to more uniform formation of a fibrous web, or mat 24, on the forming surface 23. In accordance with this invention the cross-machine-direction flow is made more uniform by accelerating the air-fiber flow as it is being directed into the release zone 18 from the working section 16. In order to accomplish this result a guide plate 82 is positioned close to the periphery of the seal roll 80, and includes a lower surface 84 which is spaced from the periphery of the main drum 14 to provide a confining channel through which the air-fiber stream is directed (FIGS. 1 and 2). In the preferred embodiment of this invention the lower surface 84 of the guide plate is positioned approximately 0.375 inches from the outer periphery of the main drum 14. In order to accelerate the flow as it is directed into the release zone 18, a lip member 86 (FIG. 2) is attached to the upper surface of the guide plate 82, and includes a lower edge 88 which is spaced closer to the periphery of the main drum than the lower surface 84 of the guide plate 82 (FIG. 2). As a result of the above construction the guide plate 82 and the lip member 86 cooperate with the outer periphery of the main drum 14 to provide a flow-accelerating nozzle for the air and fibers. This acceleration smooths out the cross-machine-direction profile of the flow, and this contributes to more uniform formation of a fibrous web, or mat 24 on the forming surface 23.

Figure 4:
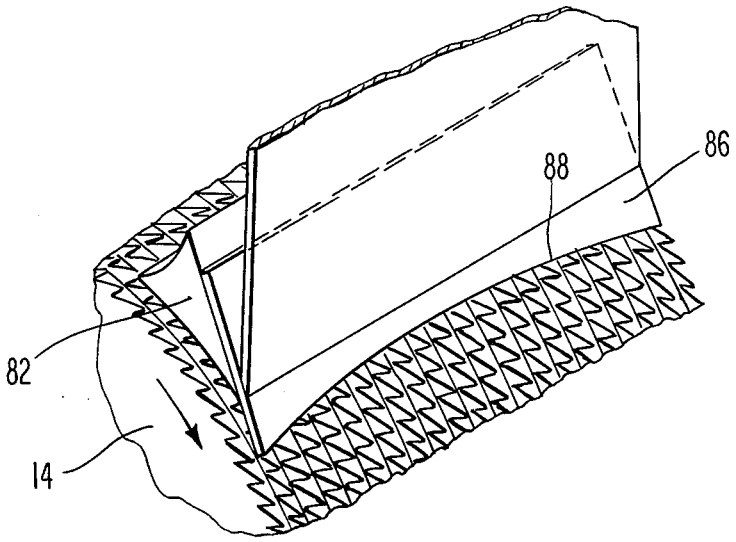
FIG. 4 is an enlarged isometric view showing details of construction of the exit from the fiber working section.

Referring to FIG. 4, the lower edge 88 of the lip member 86 has a convex curvature in the cross-machine-direction. This construction provides an exit between the lower edge 88 of the lip member and the outer periphery of the main drum 14 which is deeper in the central region than at the marginal ends. It has been found that this configuration prevents excessively high basis weight formation of the longitudinal edges of the fibrous mat 24 formed on the forming surface 23. In other words, the formed mat 24 has a more uniform basis weight across its entire width that it would otherwise have if the exit between the lip member 86 and the main drum 14 were of a substantially uniform thickness for the entire extent of the cross-machine-direction. If desired, the lower edge of the lip member can be provided with a nonlinear profile other than a convex curvature to provide a varying depth along the cross-machine-direction of the nozzle exit. In this manner the cross-machine-direction basis weight of the formed fibrous structure can be varied in a controlled manner.

Referring again to FIGS. 1 and 2, pressurized air is directed through a conduit 92, and is deflected by an adjustable flap 94 toward the periphery of the main drum 14 adjacent the lower edge 88 of the lip member 86. By directing pressurized air against the periphery of the main drum premature separation of fibers from said periphery is avoided. This serves to partially control the path of fiber flow to the foraminous forming surface 23. As indicated above, the flap 94 is adjustable, and can be positioned in any desired orientation to provide the proper direction of air flow from the conduit 92 into engagement with the periphery of the main drum 14. In accordance with a preferred operation of this apparatus a forward edge 96 of the flap 94 (FIG. 2) is positioned less than 1 inch away from the lower edge 88 of the lip member 86. Most preferably the spacing between the edge 96 of the flap and the edge 88 of the lip member is about $\frac{3}{4}$ inch.

As the main drum 14 rotates into its vertically extending fiber release zone 18 a majority of the air-fiber flow will be projected from the peripheral surface of said main drum by centrifugal force. Some of the textile-length fibers will remain hooked on the teeth of the main drum; however, almost all of the papermaking length fibers will be projected from the periphery of said drum. Thereafter the flow will be directed through the formation chamber 20 onto the foraminous forming surface 23. The pressure differential established through vacuum box 22 aids in directing the fibers to the forming surface.

Referring to FIG. 1, the formation chamber 20 includes a back wall 98 and a front wall 100. A doffing member 102 extends for the entire cross-machine-direction of the apparatus 10, and has an upper edge 104 positioned extremely close to the periphery of the main drum 14 without interfering with the rotation of said drum. The upper edge 104 of the doffing member 102 will intercept any air-fiber flow adjacent the periphery of the main drum as said periphery is directed past said doffing member. The intercepted air-fiber flow will be deflected, or doffed into the formation chamber 20 for deposition on the foraminous forming surface 23. An outwardly directed ledge 106 of the doffing member 102 serves to further deflect the flow of air and fibers moving into the formation chamber 20 to aid in controlling the path of travel of the air-fiber flow as said flow moves to the forming surface 23.

Although the doffing member 102 is effective in removing, or intercepting air-fiber flow which is close to the periphery of the main drum, it is not effective in removing air flow which is carried between the teeth of the main drum past the upper edge 104 of the doffing member 102. If the air trapped between the teeth of the main drum 14 is directed to the inlet section 12 of the apparatus by rotation of said main drum, it will disturb the laminate fibrous feed 13. This disturbance causes nonuniform feed of fibrous material against the toothed periphery of the main drum 14, and that results in nonuniformities in basis weight in the formed fibrous mat 24.

Referring to FIG. 1, a seal arrangement 106 prevents the textile-length fibers from remaining hooked on the teeth of the main drum as the teeth moves past the doffing member 102, and also prevents the undesirable conveyance of air into the inlet section 12 by the high speed rotation of said main drum 14. The seal arrangement 106 includes a seal pad 110 and a nozzle 112 adjacent opposed ends of a lower housing wall 108. The nozzle 112 has a outlet oriented for directing a gas against the outer periphery of the main drum 14 with a force component in a direction opposed to the direction of rotation of said drum. The seal pad 110 is spaced from the nozzle in the direction of rotation of the drum and is in engagement with the projections of the outer periphery of said drum. The seal pad creates a back pressure in the region of the main drum adjacent the nozzle to aid in doffing fibers from the teeth of the main drum for conveyance to the forming surface. Directing a gas against the outer periphery of the main drum through the nozzle removes air which is trapped between the teeth of the main drum to prevent that air from being conveyed to the inlet section of the apparatus. If the air were permitted to be conveyed to the inlet section of the apparatus, it would adversely affect uniform movement of the fibrous feed, and thereby adversely affect the uniformity in basis weight of the formed fibrous structure. The seal arrangement 106 is the joint invention of Joel P. Gotchel, Aris C. Spengos and Henry J. Norton, and is specifically covered in U.S. patent application Ser. No. 715,138, filed on the same date as this application, and entitled APPARATUS AND METHOD EMPLOYING A SEAL ARRANGEMENT FOR THE DRY-FORMING OF FIBROUS STRUCTURES. For further details of the seal arrangement reference should by had to that application which is incorporated herein by reference.

As indicated earlier, the laminate feed 13, in accordance with the preferred embodiment of this invention, includes a loosely compacted upper layer 28 of textile-length fibers greater than $\frac{1}{4}$ inch in length, and a loosely compacted bottom layer 30 of short cellulosic fibers of a papermaking length less than $\frac{1}{4}$ inch; preferably wood pulp fibers. It has been found that the laminate feed 13 can be most reliably directed into engagement with the toothed periphery of the main drum 14 by engaging the opposed flat surfaces of the laminate feed with moving feed surfaces, such as the outer peripheries of the upper and lower feed rolls 25 and 26, respectively. Considerable difficulty is encountered in attempting to feed the laminate 13 over a stationary surface, such as the supporting surface of a stationary nose bar. When the laminate feed 13 is directed over a stationary surface it encounters sheer forces which cause it to buckle. This impairs the uniformity with which fibers are presented to the toothed periphery of the main drum 14, and thereby effects the uniformity of the fibrous mat 24 which is ultimately directed onto the forming surface 23.

It has been found that the most effective individualization of the fibers in the laminate feed 13 is achieved by positioning the short fiber layer so that it is the first layer to be engaged by the teeth of the rotating main drum 14. In the embodiment shown and described in this application the short fiber layer 30 is the botton layer, and is initially engaged by the teeth of the main drum 14 as said main drum is rotated in a clockwise direction (FIG. 1). As the teeth of the main drum 14 are rotated into engagement with the layer of short fibers they separate fibers therefrom. Since the fibers in layer 30 are less than $\frac{1}{4}$ inch they are not strongly intertwined. Therefore, the teeth of the drum do not pull excessively large chunks of intertwined fibers from the layer 30. The action of the teeth on the long fiber layer 28 is imposed on said layer in the nip between the top feed roll 25 and the main drum 14. It is in that nip that the feed 13 is compressed to sandwich the long fiber layer 28 between the top feed roll 25 and the short fiber layer 30. The teeth of the main drum moving through the nip are effective to pull fibers from the long fiber layer 28. As explained earlier, the top feed roll 25 is provided with projections which engage the top layer 28. The projections hold, or support the layer 28 as said layer experiences the action of the teeth of the main drum 14. This will prevent the teeth of the main drum from pulling out excessively large chunks of fibers from the top layer. If the long fiber layer 28 were the bottom layer, it would not be effectively held when initially engaged by the teeth of the main drum 14. Since the long fibers in layer 28 are intertwined with each other into a relatively cohesive structure, the teeth of the main drum 14 would tend to pull excessively large clumps from said layer.

In accordance with the preferred method of this invention the main drum 14 is rotated at a surface speed in excess of 10,000 feet/minute, and preferably at a speed in excess of 13,000 feet/minute. The fibers separated from the laminate feed 13 are conveyed to the working section 16 by the rotation of the main drum 14. As the fibers are conveyed through the working section they are intimately worked between the main drum 14 and the cooperating sets of satellite rolls 56 and 58. This intimate working of the fibers insures that a high degree of individualization and blending of said fibers is achieved. After the fibers have been worked between the main drum 14 and the sets of satellite rolls 56 and 58, they are directed beneath the seal roll 80, and past the guide plate 82 and lip member 86. As explained earlier, the flow of individualized fibers is accelerated as it is directed past the guide plate 82 and the lip member 86 into the fiber release zone 18. The fibers are then directed into the formation chamber 20, and the pressure differential established from behind the forming surface 23 through vacuum box 22 is effective to direct the fibers onto said forming surface in the form of a fibrous mat 24. Most preferably the speed of the forming surface 23 is controlled to form a feed mat 24 having a basis weight in the range of from about 12 to about 50 oz/yd$^2$. The fibrous feed mat 24 can then be fed directly to the infeed section of a web former which is adapted to form a low basis weight fibrous web in the range of from about 1 to about 6 oz/yd$^2$, in the manner disclosed in U.S. Pat. No. 3,862,472, and referred to earlier in this application.

Having described our invention we claim:

1. An apparatus for dry-forming a fibrous structure, said apparatus including:

A. a rotatable main drum having projections on its outer periphery, said drum having a fiber release zone;

B. an inlet means outside of said release zone and including feed means for directing a fibrous feed into engagement with the outer periphery of the main drum, whereby rotation of said drum past the inlet means separates the fibers from the feed;

C. a fiber working section between said inlet means and said release zone for individualizing fibers as they are directed in a downstream direction from said inlet means to said release zone by movement of the periphery of the main drum, said fiber working section including a movable satellite member having projections on its outer periphery and a housing positioned about said satellite member, the outer periphery of said satellite member being movable along a path in which the projections are directed close to the periphery of the main drum to cooperate with said main drum for individualizing fibers;

D. a movable foraminous forming surface for intercepting the fibers after they leave the release zone of the main drum, whereby a fibrous structure is formed on said forming surface;

E. a baffle means disposed adjacent the satellite member between said satellite member and the release zone, said baffle means including a lower air-directing section positioned close to the outer periphery of the main drum, said air-directing section including an upstream air-diverting surface means for (1) intercepting air conveyed to the air-directing section by movement of the outer periphery of the main drum past the satellite member, (2) diverting a first portion of the intercepted air away from the periphery of the main drum into the region between the satellite member and baffle means, and (3) diverting a second portion of said intercepted air through a constriction provided between the outer periphery of the main drum and a lower peripheral surface segment of the air-directing section;

F. said baffle means being sealed against top and side walls of the housing to provide a barrier to the downstream movement of said first portion of diverted air to increase the static pressure adjacent the satellite member.

2. The apparatus according to claim 1, including additional baffle means adjacent the feed means and positioned close to the periphery of the main drum for restricting the area at the inlet means through which air can be pumped by high speed rotation of the main drum.

3. The apparatus according to claim 1, wherein said housing provides a passageway in the region of the fiber working section downstream of said baffle to communicate that region with an exterior source of air.

4. The apparatus according to claim 1, including a vacuum means beneath the foraminous forming surface.

5. The apparatus according to claim 2, wherein said feed means includes opposed movable surfaces for engaging opposed surfaces of the fibrous feed.

6. The apparatus according to claim 5, wherein said opposed movable surfaces are the outer surfaces of opposed upper and lower rolls, said upper roll including projections on its outer surface said additional baffle means having a lower surface positioned above the upper roll and close to the periphery thereof.

7. The apparatus according to claim 4, including an outlet orifice through which the fiber flow is directed from the fiber working section to the release zone and a formation chamber for receiving the fiber flow from the release zone and for permitting said flow to increase in thickness as it moves to the forming surface, said orifice being provided by the outer periphery of the main drum and an air-flow confining surface spaced from said outer periphery, said orifice including an upstream end adjacent the fiber working section and a downstream end adjacent the fiber release zone, the depth of the orifice adjacent the upstream end being greater than the depth adjacent the downstream end for reducing the thickness of the flow of air and fibers to accelerate said flow as said flow is directed from the working section to the fiber release zone, said flow being increased in thickness as it moves from the release zone to the forming surface through said formation chamber.

8. The apparatus according to claim 7, wherein said air-flow confining surface has a lower downstream end which is spaced from the periphery of the main drum to provide the downstream end of the orifice, the lower end of said confining surface extending in the axial direction of the main drum and being spaced at varying distances from the main drum in said axial direction for controlling the cross-machine-direction basis weight of the fibrous structure formed on the forming surface.

9. The apparatus according to claim 7, wherein said air-flow confining surface has a lower downstream end which is spaced from the periphery of the main drum to provide the downstream end of said orifice, the lower end of said confining surface extending in the axial direction of the main drum and being closer to said main drum at the axial ends thereof than in its medial region to prevent excessive fiber buildup at the margins of the fibrous structure formed on the forming surface.

10. The apparatus according to claim 9, wherein the lower end of the confining surface has a concave curvature.

11. An apparatus for dry-forming a fibrous structure, said apparatus including:

A. a rotatable main drum having projections on its outer periphery, said drum having a fiber release zone;

B. an inlet means outside of said release zone and including feed means for directing a fibrous feed into engagement with the outer periphery of the main drum, whereby rotation of the drum past the inlet means separates fibers from the feed;

C. a fiber working section between said inlet means and said release zone for individualizing fibers as they are directed in a downstream direction from said inlet means to said release zone by movement of the peripheral surface of the main drum, said fiber working section including adjacent sets of rotatable satellite rolls and a housing positioned about said sets, each set including a rotatable worker roll and a rotatable turner roll with projections on their outer peripheries, the worker roll of each set being positioned beyond its respective turner roll in the direction of movement of the outer periphery of the main drum during rotation of said drum, the rolls in each set of satellite rolls being positioned close to each other and to the periphery of the main drum for cooperating with said main drum and with each other to individualize fibers conveyed past the sets of satellite rolls by movement of the outer periphery of the main drum;

D. an outlet orifice positioned beyond the satellite rolls in the direction of movement of the outer periphery of the main drum during rotation of said drum, said outlet orifice being adapted to direct fibers to the fiber release zone from the fiber working section;

E. a foraminous forming surface for intercepting the fibers after they leave the release zone of the main drum, whereby a fibrous structure is formed on said forming surface;

F. a baffle means being sealed against the top and side walls of the housing and being disposed between the worker roll of one set of satellite rolls, which set is closest to the inlet means, and the turner roll of an adjacent set of satellite rolls; the improvement wherein said baffle means includes a lower air-directing section positioned close to the outer periphery of the main drum and having an air-diverting surface adjacent the worker roll of said one set of satellite rolls, said air-diverting surface intercepting air conveyed to it by the outer periphery of the main drum during rotational motion of said drum and diverting a first portion of the intercepted air in a first direction away from the periphery of the main drum into the region between the worker roll of said one set of satellite rolls and the baffle means, said baffle means providing a barrier to the downstream movement of said first portion of diverted air to increase the static pressure adjacent the downstream end of the worker roll of said one set of satellite rolls, said air-diverting surface also diverting a second portion of the intercepted air through a constriction provided between the outer periphery of the main drum and a peripheral surface segment of the air-directing section for conveying the second portion of air between the main drum and the turner roll of the adjacent set of satellite rolls.

12. The apparatus according to claim 11, wherein the turner roll of each set of satellite rolls is closer to the main drum than to its cooperating worker roll, and the worker roll is spaced closer to its cooperating turner roll than to the main drum.

13. The apparatus according to claim 12, wherein the worker roll of the one set of satellite rolls is closer to the main drum than the turner roll of the adjacent set of satellite rolls.

14. The apparatus according to claim 11, wherein the air-diverting surface is a curved surface.

15. The apparatus according to claim 14, wherein the air-diverting curved surface is generally convex and diverts a greater volume of air to the adjacent set of satellite rolls than into the region between the worker roll of said one set of satellite rolls and the baffle means.

16. The apparatus according to claim 15, wherein said air-directing section is a substantially cylindrical member extending for substantially the entire axial extent of the main drum.

17. The apparatus according to claim 11, wherein said air-directing section includes a downstream edge underlying the turner roll of the adjacent set of satellite rolls for insuring that the second portion of air is directed between the main drum and the turner roll of the adjacent set of satellite rolls.

18. The apparatus according to claim 16, wherein said air-directing section includes a downstream edge underlying the turner roll of the adjacent set of satellite rolls for insuring that the second portion of air is directed between the main drum and the turner roll of the adjacent set of satellite rolls.

19. The apparatus according to claim 11, wherein the distance between the outer periphery of the main drum and the segment of the periphery of the air-directing section which is closest to the outer periphery of the main drum is no greater than about 0.2 inches.

20. The apparatus according to claim 11, wherein said housing provides a passageway in a region between the worker roll of the adjacent set of satellite rolls and the exit from the working section to communicate the interior of the housing with an exterior source of air.

21. The apparatus according to claim 20, wherein the passageway in the housing is in communication with an exterior source of air at atmospheric pressure.

22. The apparatus according to claim 11, including additional baffle means adjacent the feed means and positioned close to the periphery of the main drum for restricting the area at the inlet means through which air can be pumped by high speed rotation of the main drum.

23. The apparatus according to claim 22, including a vacuum means beneath the foraminous forming surface.

24. The apparatus according to claim 23, wherein said feed means includes opposed movable surfaces for engaging opposed surfaces of the fibrous feed.

25. The apparatus according to claim 24, wherein said opposed movable surfaces are the outer surfaces of opposed upper and lower rolls, said upper roll including projections on its outer surface, said additional baffle means having a lower surface positioned above the upper roll and close to the periphery thereof.

26. The apparatus according to claim 11, wherein said outlet orifice is provided by the outer periphery of the main drum and an air-flow confining surface spaced from said outer periphery, said orifice including an upstream end adjacent the fiber working section and a downstream end adjacent the fiber release zone, the depth of the orifice adjacent the upstream end being greater than the depth adjacent the downstream end for accelerating the flow of air and fibers as said flow is directed from the working section to the fiber release zone.

27. The apparatus according to claim 26, wherein said air-flow confining surface has a lower downstream end which is spaced from the periphery of the main drum to provide the downstream end of the orifice, the lower end of said confining surface extending in the axial direction of the main drum and being spaced at varying distances from the main drum in said axial direction for controlling the cross-machine-direction basis weight of the fibrous structure formed on the forming surface.

28. The apparatus according to claim 26, wherein said air-flow confining surface has a lower downstream end which is spaced from the periphery of the main drum to provide the downstream end of said orifice, the lower end of said confining surface extending in the axial direction of the main drum and being closer to said main drum at the axial ends thereof than in its medial region to prevent excessive fiber buildup at the margins of the fibrous structure formed on the forming surface.

29. The apparatus according to claim 28, wherein the lower end of the confining surface has a concave curvature.

30. An apparatus for forming a fibrous structure, said apparatus including:

A. a rotatable main drum having projections on its outer periphery;

B. feed means for directing a fibrous feed into engagement with the outer periphery of the main drum, whereby rotation of the main drum past the feed means separates fibers from the feed;

C. a fiber release zone on the main drum at which fibers are released from the periphery of said main drum said release zone being spaced from said feed means;

D. a movable foraminous forming surface for intercepting the flow of fibers that leaves the periphery of the main drum at the fiber release zone to form a fibrous structure thereon;

E. a formation section between the release zone and forming surface for receiving the fiber flow from the release zone and for permitting said flow to increase in thickness as it is directed to the foraminous forming surface; and F. an outlet orifice through which the fibers are directed from the fiber working section to the release zone, the improvement wherein said orifice is provided by the outer periphery of the main drum and an air-flow confining surface spaced from said outer periphery, said orifice including an upstream end adjacent the fiber working section and a downstream end adjacent the fiber release zone, the downstream end of said orifice being provided between a lower downstream end of the air-flow confining surface and the periphery of the main drum, the depth of the orifice adjacent the upstream end being greater than the depth adjacent the downstream end for reducing the thickness of the flow of air and fibers to accelerate said flow as said flow is directed from the working section to the fiber release zone, said flow thereafter being increased in thickness as it moves through the formation section to the forming surface, the lower end of the confining surface extending in the axial direction of the main drum and being spaced at varying distances from the main drum in said axial direction for controlling the cross-machine-direction basis weight of the fibrous structure formed on the forming surface.

31. The apparatus according to claim 30, wherein the lower downstream end of said air-flow confining surface is closer to said main drum at the axial ends thereof than in its medial region to prevent excessive fiber buildup at the margins of the fibrous structure formed on the forming surface.

32. The apparatus according to claim 31, wherein the lower end of the confining surface has a concave curvature.

33. The apparatus according to claim 30, including a gas conveying conduit positioned for conveying a gas against the outer periphery of the main drum in the release zone, and a blower means for directing a gas through said conduit for delivery to the outer periphery of the main drum in the release zone to aid in controlling the flow of fibers at said release zone.

34. The apparatus according to claim 30, including baffle means adjacent the feed means and positioned close to the periphery of the main drum for restricting the area at the inlet means through which air can be pumped by high speed rotation of the main drum.

35. The apparatus according to claim 30, including a vacuum means beneath the foraminous forming surface.

36. The apparatus according to claim 35, wherein said feed means includes opposed movable surfaces for engaging opposed surfaces of the fibrous feed.

37. The apparatus according to claim 36, wherein said opposed movable surfaces are the outer surfaces of opposed upper and lower rolls, said upper roll including projections on its outer surface.

38. A method for dry-forming a fibrous structure including short fibers under ¼ inch in length as the predominate fiber component, said method including the steps of:

A. rotating a main drum having projections on its outer periphery;

B. directing a fibrous feed into engagement with the rotating outer periphery of the main drum, whereby rotation of the drum past the fibrous feed separates fibers from said feed, said fibrous feed including short fibers under 174 inch in length as the predominate fiber component;

C. directing fibers which have been separated from the fibrous feed into a working section including a movable satellite member positioned adjacent the main drum and having projections on its outer periphery, whereby the projections on the outer peripheries of the satellite member and main drum cooperate to individualize fibers that are directed through the working section;

D. conveying the individualized fibers from the fiber working section to a release zone on the periphery of the main drum at which the individualized fibers are released from the periphery of said main drum for subsequent conveyance to a foraminous forming surface upon which the fibrous structure is formed, said individualized fibers being directed to the release zone by the rotation of the main drum, the improvement of;

E. directing a flow of air along the periphery of the main drum as said periphery moves in a downstream direction through the working section, intercepting the flow of air after said flow has been directed between the satellite member and main drum and before it exits the working section, diverting a first portion of the intercepted air away from the periphery of the main drum and adjacent the satellite member, providing a substantially sealed barrier to the downstream movement of said first portion of air to increase the static pressure adjacent the satellite member and diverting a second portion of the intercepted air along the periphery of the main drum for conveyance by rotation of the main drum to the fiber release zone.

39. The method according to claim 38, including the step of conveying fibers released from the release zone of the main drum to a foraminous forming surface by establishing a pressure differential across said forming surface.

40. The method according to claim 38, wherein the fibrous feed is a laminate including a layer of loosely compacted textile-length fibers greater than ¼ inch in length and a layer of loosely compacted short fibers under ¼ inch in length, and wherein the step of directing the fibrous feed into engagement with the rotating outer periphery of the main drum is accomplished by engaging opposed surfaces of the laminate with peripheral surfaces of opposed, rotating feed rolls, the feed rolls engaging the layer of textile-length fibers including projections on the periphery thereof for sticking into said layer of textile-length fibers, and including the step of rotating the main drum in a direction to cause the projections thereof to first engage the short fiber layer.

41. The method according to claim 38, including the step of directing the flow of air and fibers through a constricted area between the working section and the release zone to accelerate the flow of said air and fibers as they are directed into said release zone.

42. The method according to claim 40, including the step of directing the flow of air and fibers through a constricted area between the working section and the release zone to accelerate the flow of said air and fibers as they are directed into said release zone.

43. The method according to claim 38, including rotating the main drum at a surface speed exceeding 10,000 feet/minute.

44. The method according to claim 38, including rotating the main drum at a surface speed exceeding 13,000 feet/minute.

45. A method of dry-forming a fibrous structure including short fibers under ¼ inch in length as the predominate fiber component, said method including the steps of:

A. rotating a main drum having projections on its outer periphery;

B. directing a fibrous feed into engagement with the rotating outer periphery of the main drum, whereby rotation of the drum past the fibrous feed separates fibers from said feed, said fibrous feed including short fibers under ¼ inch in length as the predominate fiber component;

C. directing separated fibers in a downstream direction through a working section by rotation of the main drum, said working section including adjacent sets of rotating satellite rolls, each set including a rotating worker roll and a rotating turner roll with projections on their outer peripheries, the worker roll of each set being positioned beyond its respective turner roll in the direction in which the main drum is rotating, the roll in each set of satellite rolls being positioned close to each other and to the periphery of the main drum for cooperating with said drum and with each other to individualize fibers conveyed through the working section by the rotating main drum;

D. conveying the individualized fibers from the fiber working section to a release zone on the main drum where the individualized fibers are released from the periphery of said main drum for subsequent conveyance to a foraminous forming surface upon which the fibrous structure is formed, said individualized fibers being directed to the release zone by the rotation of the main drum; and E. intercepting a flow of air after it has been directed past a first set of the adjacent sets of rotating satellite rolls, and before it is directed into a second set of the adjacent sets of satellite rolls;

(1) diverting a first portion of the intercepted air away from the periphery of the main drum and adjacent to the worker roll of the first set of satellite rolls;

(2) providing a substantially sealed barrier to downstream movement of said first portion of air to thereby increase the static pressure adjacent the worker roll of said first set of satellite rolls; and (3) diverting a second portion of the intercepted air along the periphery of the main drum for conveyance between the main drum and the turner roll of the second set of satellite rolls.

46. The method according to claim 45, including the step of diverting a lesser volume of air in the first portion than in the second portion.

47. The method according to claim 45, wherein the steps of intercepting the air flow, providing the barrier and diverting the air flow into the first and second portions is accomplished by positioning an air-diverting surface of a baffle close to the periphery of the main drum between the first and second sets of satellite rolls, providing a sealed housing about the fiber working section and connecting the baffle means to the interior walls of the housing to separate the first and second sets of satellite members disposed on opposite sides of the baffle means.

48. The method according to claim 45, including the step of conveying fibers released from the release zone of the main drum to a foraminous forming surface by establishing a pressure differential across said forming surface.

49. The method according to claim 45, wherein the fibrous feed is a laminate including a layer of loosely compacted textile-length fibers greater than ¼ inch in length and layer of loosely compacted short fibers under ¼ inch in length, and wherein the step of directing the fibrous feed into engagement with the rotating outer periphery of the main drum is accomplished by engaging opposed surfaces of the laminate with peripheral surfaces of opposed, rotating feed roll, the feed roll engaging the layer of textile-length fibers including projections on the periphery thereof for sticking into the layer of textile-length fibers, and including the step of rotating the main drum in a direction to cause the projections thereon to first engage the short fiber layer.

50. The method according to claim 45, including the step of directing the flow of air and fibers through a constricted area between the working section and the release zone to accelerate the flow of said air and fibers as they are directed into said release zone.

51. The method according to claim 49, including the step of directing the flow of air and fibers through a constricted area between the working section and the release zone to accelerate the flow of said air and fibers as they are directed into said release zone.

52. The method according to claim 45, including rotating the main drum at a surface speed exceeding 10,000 feet/minute.

53. The method according to claim 45, including rotating the main drum at a surface speed exceeding 13,000 feet/minute.

54. An apparatus for dry-forming a fibrous structure, said apparatus including:

A. a rotatable main drum having projections on its outer periphery, said drum having a fiber release zone;

B. an inlet means outside of said release zone and including feed means for directing a fibrous feed into engagement with the outer periphery of the main drum, whereby rotation of said drum past the inlet means separates fibers from the feed;

C. a fiber working section between said inlet means and said release zone for individualizing fibers as they are directed from said inlet means to said release zone by movement of the periphery of the main drum, said fiber working section including a movable satellite member having projections on its outer periphery, the outer periphery of said satellite member being movable along a path in which the projections are directed close to the periphery of the main drum to cooperate with said main drum for individualizing fibers;

D. a foraminous forming surface for intercepting the fibers after they leave the release zone of the main drum, whereby a fibrous structure is formed on said forming surface;

E. a baffle means disposed adjacent the satellite member and between said satellite member and the release zone, said baffle means including a lower air-directing section positioned close to the outer periphery of the main drum, said air-directing section including an upstream air-diverting surface means for (1) intercepting air conveyed to the air-directing section by movement of the outer periphery of the main drum past the satellite member, (2) diverting a first portion of the intercepted air away from the periphery of the main drum into the region between the satellite member and baffle means, and (3) diverting a second portion of said intercepted air through a constriction provided between the outer periphery of the main drum and a lower peripheral surface segment of the air-directing section; and F. an outlet orifice through which the fibers are directed from the fiber working section to the release zone, said orifice being provided by the outer periphery of the main drum and an air-flow confining surface spaced from said outer perphery, said orifice including an upstream end adjacent the fiber working section and a downstream end adjacent the fiber release zone, the depth of the orifice adjacent the upstream end being greater than the depth adjacent the downstream end for accelerating the flow of air and fibers as said flow is directed from the working section to the fiber release zone, said air flow confining surface having a lower downstream end which is spaced from the periphery of the main drum to provide the downstream end of the orifice, the lower end of said confining surface extending in the axial direction of the main drum and being spaced at varying distances from the main drum in said axial direction for controlling the cross-machine-direction basis weight of the fibrous structure formed on the forming surface.

55. The apparatus according to claim 54, wherein the lower end of said confining surface is closer to said main drum at the axial ends thereof than in its medial region to prevent excessive fiber buildup at the margins of the fibrous structure formed on the forming surface.

56. The apparatus according to claim 55, wherein the lower end of the confining surface has a concave curvature.

57. An apparatus for dry-forming a fibrous structure, said apparatus including:

A. a rotatable main drum having projections on its outer periphery, said drum having a fiber release zone;

B. an inlet means outside of said release zone and including feed means for directing a fibrous feed into engagement with the outer periphery of the main drum, whereby rotation of the drum past the inlet means separates fibers from the feed;

C. a fiber working section between said inlet means and said release zone for individualizing fibers as they are directed from said inlet means to said release zone by movement of the peripheral surface of the main drum, said fiber working section including adjacent sets of rotatable satellite rolls, each set including a rotatable worker roll and a rotatable turner roll with projections on their outer peripheries, the worker roll of each set being positioned beyond its respective turner roll in the direction of movement of the outer periphery of the main drum during rotation of said said drum, the rolls in each set of satellite rolls being positioned close to each other and to the periphery of the main drum for cooperating with said main drum and with each other to individualize fibers conveyed past the sets of satellite rolls by movement of the outer periphery of the main drum, the turner roll of each set of satellite rolls being closer to the main drum than to its cooperating worker roll and the worker roll of each set being spaced closer to its cooperating turner roll than to the main drum;

D. an outlet orifice positioned beyond the satellite rolls in the direction of movement of the outer periphery of the main drum during rotation of said drum, said outlet orifice being adapted to direct fibers to the fiber release zone from the fiber working section;

E. a foraminous forming surface for intercepting the fibers after they leave the release zone of the main drum, whereby a fibrous structure is formed on said forming surface;

F. a baffle means disposed between the worker roll of one set of satellite rolls, which set is closest to the inlet means, and the turner roll of an adjacent set of satellite rolls, the worker roll of the one set of satellite rolls being closer to the main drum than the turner roll of the adjacent set of satellite rolls, said baffle means includes a lower air-directing section positioned close to the outer periphery of the main drum and having an air-diverting surface adjacent the worker roll of said one set of satellite rolls, said air-diverting surface intercepting air conveyed to it by the outer periphery of the main drum during rotational motion of said drum and diverting a portion of the intercepted air in a first direction away from the periphery of the main drum into the region between the worker roll of said one set of satellite rolls and the baffle means, said air-diverting surface also diverting a second portion of the intercepted air through a constriction provided between the outer periphery of the main drum and a peripheral surface segment of the air-directing section for conveying the second portion of air between the main drum and the turner roll of the adjacent set of satellite rolls.

58. An apparatus for dry-forming a fibrous structure, said apparatus including:

A. a rotatable main drum having projections on its outer periphery, said drum having a fiber release zone;

B. an inlet means outside of said release zone and including feed means for directing a fibrous feed into engagement with the outer periphery of the main drum, whereby rotation of the drum past the inlet means separates fibers from the feed;

C. a fiber working section between said inlet means and said release zone for individualizing fibers as they are directed from said inlet means to said release zone by movement of the peripheral surface of the main drum, said fiber working section including adjacent sets of rotatable satellite rolls, each set including a rotatable worker roll and a rotatable turner roll with projections on their outer peripheries, the worker roll of each set being positioned beyond its repective turner roll in the direction of movement of the outer periphery of the main drum during rotation of said drum, the rolls in each set of satellite rolls being positioned close to each other and to the periphery of the main drum for cooperating with said main drum and with each other to individualize fibers conveyed past the sets of satellite rolls by movement of the outer periphery of the main drum;

D. an outlet orifice positioned beyond the satellite rolls in the direction of movement of the outer periphery of the main drum during rotation of said drum, said outlet orifice being adapted to direct fibers to the fiber release zone from the fiber working section;

E. a foraminous forming surface for intercepting the fibers after they leave the release zone of the main drum, whereby a fibrous structure is formed on said forming surface;

F. A baffle means disposed between the worker roll of one set of satellite rolls, which set is closest to the inlet means, and the turner roll of an adjacent set of satellite rolls; the improvement wherein said baffle means includes a lower air-directing section positioned close to the outer periphery of the main drum and having an air-diverting surface adjacent the worker roll of said one set of satellite rolls, said air-diverting surface intercepting air conveyed to it by the outer periphery of the main drum during rotational motion of said drum and diverting a portion of the intercepted air in a first direction away from the periphery of the main drum into the region between the worker roll of said one set of satellite rolls and the baffle means, said air-diverting surface also diverting a second portion of the intercepted air through a constriction provided between the outer periphery of the main drum and a peripheral surface segment of the air-directing section for conveying the second portion of air between the main drum and the turner roll of the adjacent set of satellite rolls, wherein the distance between the outer periphery of the main drum and the segment of the periphery of the air directing section that is closest to the outer periphery of the main drum is no greater than about 0.2 inches.

59. The method according to claim 47, including providing a passageway through a housing wall in a region between the worker roll of the second set of satellite rolls and the exit from the working section for communicating the interior of the housing with an exterior source of air.

60. A method for dry-forming a fibrous structure including short fibers under ¼ inch in length as the predominate fiver component, by weight, and longer reinforcing fibers, said method including the steps of:

A. rotating a main drum having projections on its outer periphery at a surface speed in excess of 10,000 feet/minute;

B. directing a fibrous feed into engagement with the rotating outer periphery of the main drum to separate fibers from said feed, said feed including a predominant fiber component, by weight, of short fibers under ¼ inch in length and a minor fiber component, by weight, of longer reinforcing fibers;

C. directing the separated fibers into a fiber working section by rotation by rotation of the drum, said fiber working section including a rotating satellite member having projections on its outer periphery for cooperating with the projections on the rotating main drum to individualize fibers in said working section, said rotating satellite member moving fibers around it in its direction of rotation;

D. controlling the pressure in the working section to minimize undesirable air-flow in a direction counter to the direction of fiber flow on the rotating satellite member, said undesirable air-flow being caused, at least in part, by the high speed rotation of the main drum;

E. directing the individualized fibers from the fiber working section to a release zone on the main drum where they are released from the periphery of said main drum; and F. conveying the released fibers to a foraminous forming surface to form the fibrous structure.

61. The method according to claim 60, including rotating the main drum at a surface speed in excess of 13,000 feet/minute.

62. The method according to claim 60, including the steps of directing the fibers into a working section including a plurality of rotating satellite members positioned adjacent the main drum and having projections on their outer peripheries for cooperating with the projections on the main drum to individualize the fibers, said rotating satellite members moving fibers with them in their direction of rotation, and controlling the pressure in the working section to minimize undesirable air-flow counter to the direction of fiber flow on said satellite members.

* * * * *

UNITED STATES PATENT OFFICE

CERTIFICATE OF CORRECTION

Patent No. 4,097,965 Dated July 4, 1978

Inventor(s) Joel P. Gotchel and Henry J. Norton

It is certified that error appears in the above-identified patent and that said Letters Patent are hereby corrected as shown below:

Column 7, line 55, change "the" second occurrence to --to--;
Column 11, line 11, change "that" to --than--;
Column 12, line 15, change "moves" to --move--;
Column 14, line 10, delete "the" first occurrence;
Column 18, line 11, insert --,-- after "drum";
Column 19, line 20, change "174" to --1/4--;
Column 19, line 67, change "rolls" second occurrence to --roll--;
Column 20, line 4, change "thereof" to --thereon--;
Column 20, line 44, insert --main-- after "said";
Column 21, line 27, insert --a-- after "and";
Column 24, line 25, change "A" to --a--;
Column 24, line 60, change "dominate fiver" to -- dominate fiber--;
Column 25, line 4, delete "by rotation" first occurrence.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*